United States Patent [19]

Iwata et al.

[11] 4,068,150

[45] Jan. 10, 1978

[54] VOLTAGE INDICATION MEANS FOR AN ELECTRONIC FLASHING DEVICE

[75] Inventors: Hiroshi Iwata, Osaka; Tetsuo Yamaoka, Suita, both of Japan

[73] Assignee: West Electric Co., Ltd., Osaka, Japan

[21] Appl. No.: 665,243

[22] Filed: Mar. 9, 1976

[30] Foreign Application Priority Data

| | | |
|---|---|---|
| Mar. 14, 1975 | Japan | 50-31672 |
| Mar. 14, 1975 | Japan | 50-31673 |
| Dec. 19, 1975 | Japan | 50-152652 |

[51] Int. Cl.[2] ..... H05B 41/32

[52] U.S. Cl. ..... 315/241 P; 315/135; 315/136; 354/127

[58] Field of Search ..... 315/241 P, 209 R, 129, 315/135, 136; 354/127, 145

[56] References Cited

U.S. PATENT DOCUMENTS 3,831,079 8/1974 Iwata ..... 315/241 P

*Primary Examiner*—Eugene R. LaRoche

*Attorney, Agent, or Firm*—Stevens, Davis, Miller & Mosher

[57] ABSTRACT

Voltage indication means for an electronic flashing device in which a low D.C. voltage is converted to a high D.C. voltage by a DC-DC converter circuit and energy stored in a main discharging capacitor is supplied to a flashing discharge tube to fire it, wherein the charged voltage of the main discharge capacitor is indicated by utilizing the fact that the charged voltage of the main capacitor is in equivalent relation with a voltage generated in the DC-DC converter.

24 Claims, 12 Drawing Figures

VOLTAGE INDICATION MEANS FOR AN ELECTRONIC FLASHING DEVICE

The present invention relates to voltage indication means in an electronic flashing device.

Generally, in many electronic flashing devices, the charging of a main discharging capacitor which supplies firing energy to a flashing discharge tube is effected by a DC-DC converter, and the indication of sufficient energy having been stored in the main discharging capacitor is effected by firing or enabling a luminescent device such as LED (light emission diode) utilizing a voltage generated in the DC-DC converter as disclosed in U.S. Pat. No. 3,831,079.

In the indicator of the above patent, however, a voltage regulator circuit is required to fire the luminescent device and hence the number of circuit components required increases. Time-consuming and troublesome circuit adjustments are also required therefor, and the circuit is complex.

It is a first object of the present invention to provide an indication means capable of firing the luminescent device by a simple circuit configuration without requiring such a voltage regulator circuit in the DC-DC converter circuit which generates a voltage correlated with the charged voltage of the main discharging capacitor.

It is a second object of the present invention to provide indication means which causes the luminescent device to fire momentarily when the voltage in the DC-DC converter circuit which is correlated to the charged voltage of the main discharge capacitor reaches a voltage required to effectively fire the luminescent device.

It is a third object of the present invention to provide indication means which is positively and effectively enabled to indicate the charged voltage of the main discharge capacitor utilizing the voltage of the DC-DC converter circuit which is correlated with the main discharging capacitor, without being affected by variations in ambient temperature and power supply voltage.

The foregoing and other object, features and advantages of the present invention will become more apparent from the following detailed description of the preferred embodiments of the invention when taken in conjunction with the accompanying drawings, in which.

Figure 1:
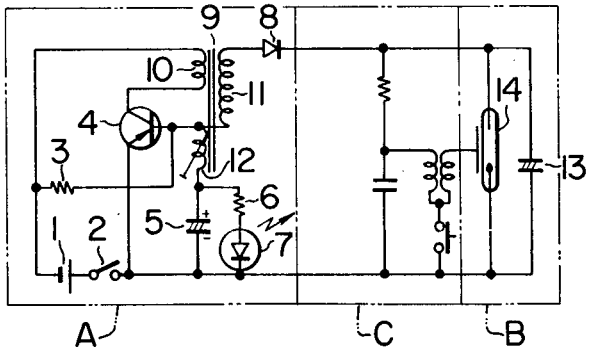
FIG. 1 is an electrical circuit diagram of one embodiment of a voltage indication means of an electronic flashing device according to the present invention.

Now referring to FIG. 1 which shows an electrical circuit diagram of an electronic flashing device including the voltage indication means in accordance with one embodiment of the present invention, the flashing device comprises a DC-DC converter A which converts the D.C. power of a supply 1 to a stepped-up D.C., a main light emitting circuit B including a main discharging capacitor 13 and a flashing discharge tube 14, and a trigger circuit C which generates a high voltage to fire the flashing discharge tube 14.

The DC-DC converter A comprises a closed loop which includes the D.C. power supply 1, a power switch 2, an oscillating transistor 4 and a primary winding 10 of an oscillating transformer 9, a biasing resistor 3 for the oscillating transistor 4, a series connection of an auxiliary winding 12 of the oscillating transformer 9 connected across the base-emitter junction of the oscillating transistor 4 and a sub-capacitor 5, a resistor 6 and an LED 7 connected to the series connection, and a diode 8 which rectifies the voltage generated across a secondary winding 11 of the oscillating transformer 9.

In operation, when the power switch 2 is turned on, the oscillating transistor 4 is biased through the biasing resistor 3 to initiate the oscillation so that there appears across the secondary winding 11 of the oscillating transformer 9 a voltage proportional to the ratio of the number of turns $N_1$ of the primary winding 10 and the number of turns $N_2$ of the secondary winding 11, that is;

$$E_2 = \frac{N_2}{N_1} E_1 \tag{1}$$

where $E_1$ and $E_2$ are voltages appearing across the primary and secondary windings respectively. The voltage $E_2$ is rectified by the diode 8 and stored in the main discharging capacitor 13. By the operation of the DC-DC converter circuit A, the sub-capacitor 5 is charged by a voltage $E_b$;

$$E_b = \frac{N_b}{N_1} E_1 \tag{2}$$

appearing across the auxiliary winding 12 of the oscillating transformer 9 which voltage is determined by a ratio of the turn number $N_b$ of the auxiliary winding 12 and the turn number $N_1$ of the primary winding 10. By putting $$E_1 = \frac{N_1}{N_2} E_2$$

derived from the equation (1) into the equation (2), $$E_b = \frac{N_b}{N_1} \cdot \frac{N_1}{N_2} \cdot E_2 = \frac{N_b}{N_2} E_2 \quad (3)$$

Thus, a voltage proportional to the voltage across the main discharging capacitor 13 charges the sub-capacitor 5. Accordingly, by using the charged voltage of the sub-capacitor 5 to fire the LED 7 connected to the sub-capacitor 5, it is possible to indicate the charged voltage of the main discharging capacitor 13. The LED 7 has a characteristic voltage or a threshold voltage for firing depending on the type of the element. For example, an LED emitting a red light has a threshold voltage of about 1.2 volts. In this case, when the threshold voltage of the LED 7 is set to $V_D = 1.2$ volts and the charged voltage of the main discharging capacitor 13 is set to $E_2'$, the charged voltage $E_b'$ of the sub-capacitor 5 should be equal to $V_D$. This is attained by appropriately setting the number of turns $N_b$ of the auxiliary winding 12. That is, from the equation (3), $$N_b = \frac{N_2}{E_2} \cdot E_b \quad (4)$$

By substituting $E_2$ and $E_b$ by $E_2'$ and $V_D$, respectively, $$N_b = \frac{N_2}{E_2'} \cdot V_D \quad (5)$$

It is thus possible to indicate a desired charged voltage of the main discharging capacitor 13 even when the LED 7 has a different threshold voltage, by merely selecting the number of turns $N_b$ of the auxiliary winding 12 at a proper number determined by the equation (5).

As stated above, the charged voltage of the main discharging capacitor 13 can be indicated by merely selecting the number of turns of the auxiliary winding 12 of the oscillating transformer 9 depending on the particular LED 7 used, without requiring an additional voltage regulator circuit.

Figure 2:
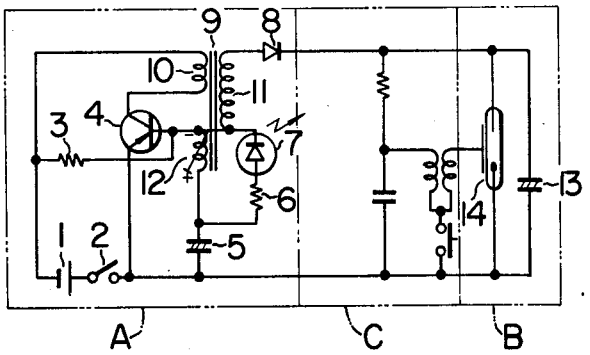
FIG. 2 is an electrical circuit diagram of a second embodiment of the voltage indication means of the present invention.

FIG. 2 shows an electrical circuit diagram of the electronic flashing device including the voltage indication means according to a second embodiment of the present invention, wherein the resistor 6 and the LED 7 which have been connected to the sub-capacitor 5 in the first embodiment are now connected across the auxiliary windings of the oscillating transformer 9. In the circuit of FIG. 2, when the power switch 2 is turned on, the DC-DC converter circuit A starts to oscillate, as in the case of the first embodiment, so that there appears across the auxiliary winding 12 of the oscillating transformer 9 a voltage as defined by the equation (3), which voltage is correlated to the voltage generated across the secondary winding 11 of the oscillating transformer 9 which charges the main discharging capacitor 13. Thus, by using the voltage generated across the auxiliary winding 12 to fire the LED 7, the charged voltage of the main discharging capacitor 13 is equivalently indicated.

In the present embodiment, like in the previous embodiment, it is possible to indicate the charged voltage of the main discharging capacitor 13 by the LED 7 which is an indication element by merely selecting appropriate number of turns $N_b$ of the auxiliary winding 12 of the oscillating transformer 9 based on the equations (4) and (5).

Figure 3:
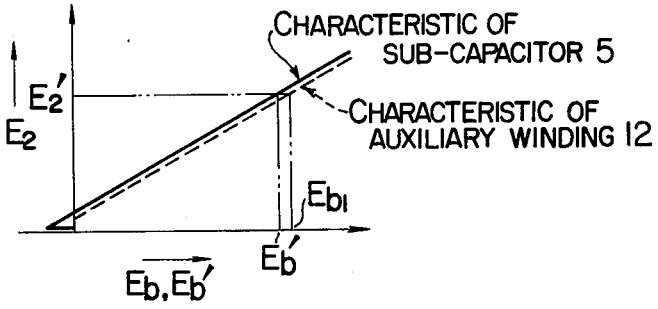
FIG. 3 shows the relations between the charged voltage of the main discharging capacitor and the voltages across an auxiliary winding of an oscillation transformer of the DC-DC converter circuit and across a sub-capacitor.

While the relations among the charged voltage of the main discharging capacitor 13, the charged voltage of the sub-capacitor 5 and the voltage of the auxiliary winding 12 are shown by the equations (1) ~ (5), they are also shown in the graph of FIG. 3. When the desired charged voltage of the main discharging capacitor 13 to be indicated is represented by $E_2'$, the charged voltage of the sub-capacitor is given by $E_b'$, and the voltage across the auxiliary winding 12 is $E_{bl}$ which is substantially equal to $E_b'$. In this way, the charged voltage of the main discharging capacitor 13 can be equivalently indicated by the voltages of the sub-capacitor 5 and the auxiliary winding 12.

Figure 4:
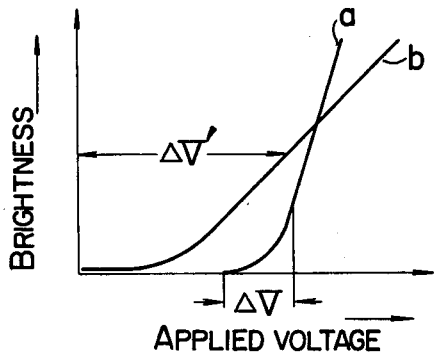
FIG. 4 shows applied voltage vs. brightness light emission characteristics for a luminescent light such as a tungsten lamp and an LED, respectively.

In addition to the LED, an incandescent lamp or a plasma discharge tube may be used as the light emitting element. The LED and a tungsten lamp, which is a kind of incandescent lamp, have light emitting characteristics with respect to an applied voltage as shown by (a) and (b) in FIG. 4 respectively. That is, before a predetermined brightness is reached, the brightness increases gradually with the applied voltage in a voltage range of $\Delta V$ or $\Delta V'$. As a result, the firing of the LED or lamp does not occur instantaneously as the voltage of the main discharging capacitor 13 reaches a predetermined charged voltage. This makes identification of the firing point difficult.

Figure 5:
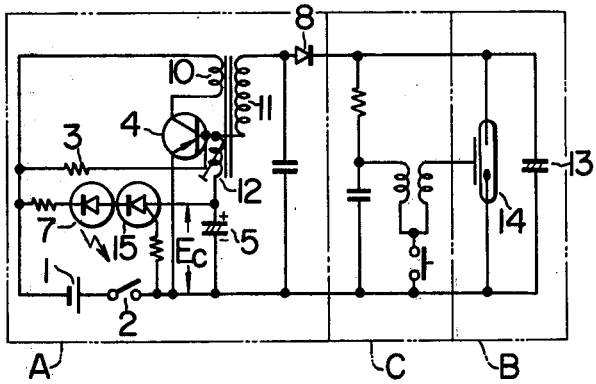
FIG. 5 shows an electrical circuit diagram of a third embodiment of the voltage indication means of the present invention.

FIG. 5 shows an electrical circuit diagram of the electronic flashing device having the voltage indication means in accordance with a third embodiment of the present invention, which has overcome the above problem.

Figure 6:
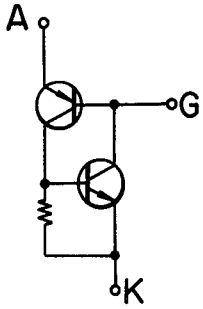
FIG. 6 shows a transistor equivalent circuit of a switching device used in the third embodiment of FIG. 5.

As shown, in the present embodiment, there are provided across the sub-capacitor 5 and the negative terminal of the power supply battery 1 the LED 7 and a switching device 15, as shown in an equivalent circuit of FIG. 6, which switching device 15 may be a programmable unijunction transistor (PUT), a silicon bilateral switch (SBS), a silicon controlled switch (SCS), or a silicon controlled rectifier (SCR) together with certain circuit modification, etc. A control electrode of the switching device 15 is connected to the other end of the sub-capacitor 5 through a resistor.

In FIG. 5, as the sub-capacitor 5 is charged by the voltage shown in FIG. 3 and the charged voltage reaches a predetermined magnitude, that is, a voltage which renders the switching device 15 conductive, the switching device 15 conducts and a current flows from the power supply battery 1 through the switch, the emitter-base of the oscillating transistor 4, the auxiliary winding 12 and the switching device 15 to the LED 7 which functions as the light emitting element, so that the LED is ready for firing. Since the auxiliary winding 12 is connected as shown in the drawing, the voltage $E_b$ generated across the auxiliary winding 12 is superimposed on the voltage of the power supply battery 1 and applied across the LED 7 so that the LED is fired by the resulting high voltage generated by the superposition.

In the present embodiment, the charged voltage $E_2'$ of the main discharging capacitor 13 to be indicated can be substituted by the gate voltage for rendering the switching device 15 conductive. Accordingly, the voltage $V_D$ in the equation (5) may be substituted by the gate voltage $V_G$ in determining the number of turns $N_b$ of the auxiliary winding 12 of the oscillating transformer 9.

Since the voltage $E_b$ generated across the auxiliary winding 12 is superimposed on the voltage of the power supply battery 1 to be applied across the LED 7, this is very advantageous in operation compared with the case where the voltage of the power supply battery 1 only is applied. The reason is as follows; in recent years electronic flashing devices usually use small size, small power batteries such as the UM-3 type for the purpose of miniaturization and the terminal voltage of the power supply is in many cases on the order of 3.0 volts. If the LED 7 is an LED emitting green light having a threshold voltage of 1.6 volts and the switching device 15 is an SBS having a saturation voltage of 1.2 volts, a voltage above 1.6 + 1.2 = 2.8 volts is required to fire the LED 7. Since there is a margin of only 0.2 volt between the power supply voltage 3.0 volts and the firing voltage 2.8 volts, the LED 7 will not be fired if the power supply battery degrades even a little through the service life. However, when the voltage $E_b$ generated across the auxiliary winding 12 is superimposed on the power supply battery 1 as described above, the LED can be fired even after the battery 1 has been conditioned to discharge below 2.8 volts.

Figure 7:
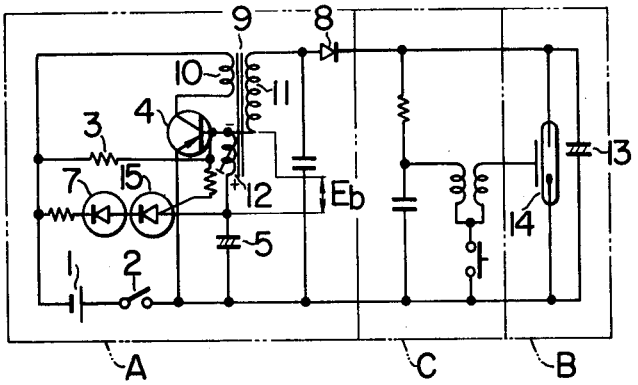
FIG. 7 shows an electrical circuit diagram of a fourth embodiment of the voltage indication means of the present invention.

FIG. 7 shows an electrical circuit diagram of the electronic flashing device having the voltage indication means in accordance with a fourth embodiment of the present invention, in which the switching device is operated by the voltage generated across the auxiliary winding. As stated above, since the voltage $E_b$ across the auxiliary winding 12 is correlated to the voltage of the main discharging capacitor 13, when the switching device 15 is operated by the voltage $E_b$, the LED 7 can be instantaneously fired as is the case in the third embodiment.

Figure 8:
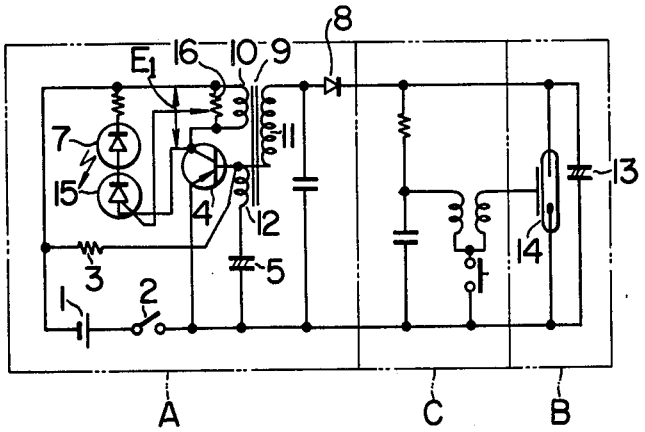
FIG. 8 shows an electrical circuit diagram of a fifth embodiment of the voltage indication means of the present invention.

FIG. 8 shows an electrical circuit diagram of the electronic flashing device having the voltage indication means in accordance with a fifth embodiment of the present invention, in which the switching device and the LED are connected across the primary winding 10 of the oscillating transformer 9.

In FIG. 8, the voltage $E_1$ across the primary winding 10 of the oscillating transformer 9 is derived from the equation (1) as follows;

$$E_1 = \frac{N_1}{N_2} \cdot E_2 \qquad (6)$$

Since the voltage $E_1$ across the primary winding 10 is proportional to the voltage generated across the secondary winding 11, when a fraction of the voltage $E_1$ derived through a voltage dividing resistor 16 connected across the primary winding 10 is applied to the control electrode of the switching device 15 to render the switching device 15 conductive, the LED 7 can be instantaneously fired, as is the case of the previous embodiment, to equivalently indicate the charged voltage of the main discharging capacitor 13.

Figure 9:
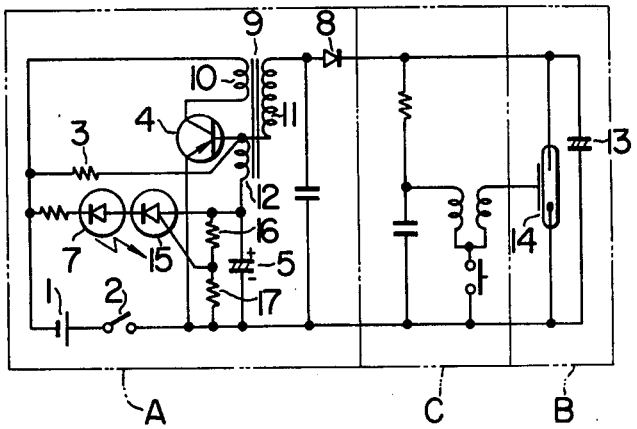
FIG. 9 shows an electrical circuit diagram of a sixth embodiment of the voltage indication means of the present invention.

In the previous third and fourth embodiments, like in the fifth embodiment, the desired charged voltage of the main discharging capacitor 13 can be indicated by the LED 7 by applying a fraction of the voltage appearing across the sub-capacitor 5 and the auxiliary winding 12 derived through a voltage dividing resistor, to the switching device 15 while using a dividing resistor 17 shown in FIG. 9. When it is desired to adjust the operation timing of the switching device 15 after the number of turns of the auxiliary winding 12, which is determined in connection with the desired voltage to be charged in the main discharging capacitor 13 to be indicated, has been set, that is, when it is desired to change the indication voltage of the main discharging capacitor 13, the voltage applied to the switching device 15 may be adjusted by the resistor 17. The resistor 17 may also be connected across the auxiliary winding 12 to actuate the switching device 15 in a similar manner as mentioned above to fire the LED 7.

Figure 10:
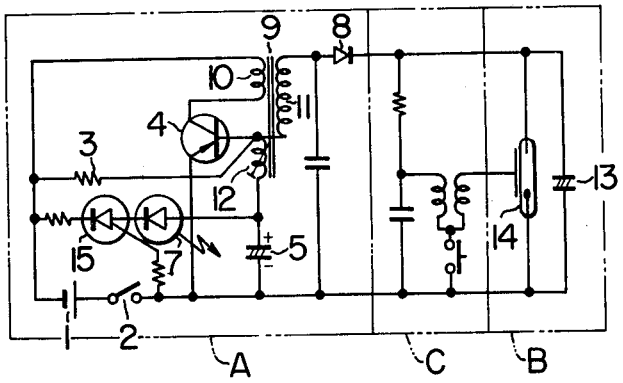
FIG. 10 shows an electrical circuit diagram of a seventh embodiment of the voltage indication means of the present invention.

FIG. 10 shows an electrical circuit diagram of the electronic flashing device having the voltage indication means in accordance with a seventh embodiment of the present invention, in which the gate voltage applied to switching device 15 is prevented from being changed with the temperature. That is, when the LED 7 is connected to the cathode of the switching device 15 as is the case of the embodiments shown in FIGS. 5 ~ 9, the conduction of the switching device 15 depends on the gate voltage and if the ambient temperature changes the gate voltage of the switching device 15 changes correspondingly to the change in temperature, resulting in a change in the indication of the charged voltage of the main discharging capacitor 13.

In this connection, in the present embodiment, the LED 7 is connected to the anode of the switching device 15. As a result, an apparent voltage which is the gate voltage $V_G$ plus forward voltage drop $V_L$ of the LED 7 is applied to the anode-gate of the switching device 15. Thus, the ratio of this voltage to the gate voltage $V_G$ only of the switching device 15 is $V_G/V_G+V_L$ and even when the gate voltage $V_G$ changes with temperature the LED 7 is not substantially affected by the temperature. In this manner the influence of the temperature can be minimized by the action of the forward voltage drop $V_L$.

For example, when the switching device 15 is an SBS having $V_G$ of 0.6 volt and the LED 7 is an LED emitting red light and having a threshold voltage of 1.3 volts, the charged voltage of the sub-capacitor 5 need be 0.6 + 1.3 = 1.9 volts. The proportion of the voltage $V_G$ of the switching device 15 is $$0.6/1.9 = 0.31$$

Thus, to compare with the gate voltage of the switching device 15 where the LED 7 is connected to the cathode, the influence of the temperature can be suppressed by the factor of about three, and no practical affect is observed in indicating the charged voltage of the main discharging capacitor 13.

Where the control electrode of the switching device 15 is connected to the other end of the auxiliary winding 12 to which the LED 7 is connected through the resistor, a similar operation can be attained.

Figure 11:
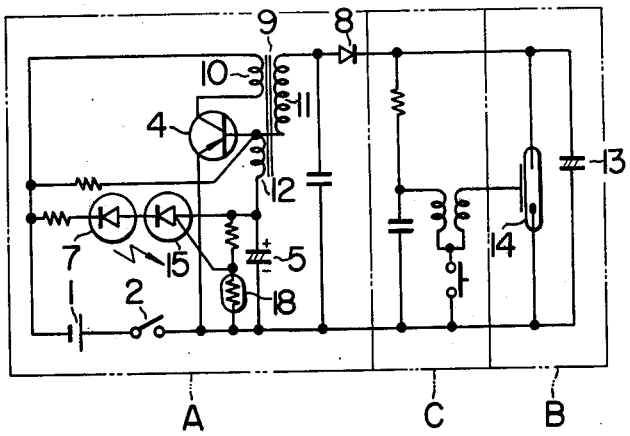
FIG. 11 shows an electrical circuit diagram of an eighth embodiment of the voltage indication means of the present invention.

FIG. 11 shows an electrical circuit diagram of the electronic flashing device having the voltage indication means in accordance with an eighth embodiment of the present invention, in which the influence of temperature on the switching device is suppressed further than in the embodiment of FIG. 10.

Figure 12:
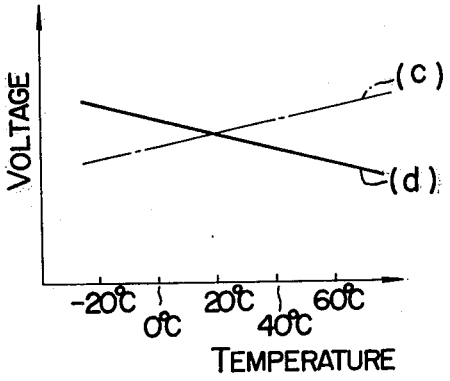
FIG. 12 shows the temperature characteristic of the voltage indication means of the present invention having an improved temperature characteristic.

In FIG. 11, a resistor 18 having a positive temperature characteristic is connected as shown to suppress the influence of temperature to the switching device 15. Namely, the voltage across the resistor 18 increases with temperature as shown by (c) in FIG. 12 while the gate voltage $V_G$ of the switching device 15 has a temperature characteristic as shown by (d) in FIG. 12.

Thus, as the temperature rises, the gate voltage $V_G$ falls but the voltage across the resistor 18 increases so that both voltages cancel each other to eliminate the influence of the temperature.

While a temperature compensation resistor having a positive temperature characteristic is used in the above example, a thermistor having a negative temperature characteristic may be used.

What is claimed is:

1. In an electronic flashing device having a flashing discharge tube;

a main discharging capacitor for firing said discharge tube by means of energy stored in said discharging capacitor; and a DC-DC converter including a transistor coupled to a D.C. power supply, a transformer having primary, secondary and auxiliary windings coupled to said D.C. power supply and said transistor to form an oscillatory circuit, a sub-capacitor coupled between the auxiliary winding of said transformer and said transistor, and a rectifier element interposed between the secondary winding of said transformer and said main discharging capacitor for rectifying the voltage generated across said secondary winding to allow charging of said main discharging capacitor;

a voltage indication device for indicating when the voltage across said discharging capacitor has been charged to a predetermined charged value, comprising light emitting indication means coupled to the auxiliary winding of said transformer, said light emitting indication means having a definite threshold voltage above which light is emitted and said auxiliary winding having a number of turns $N_b$ given by the relation $$N_b = \frac{N_2 V_D}{E_2'},$$

where $N_2$ designates the number of turns on said secondary winding, $V_D$ said definite threshold voltage and $E_2'$ the predetermined charged voltage of said main discharging capacitor.

2. A voltage indication device according to claim 1, wherein said light emitting indication means is connected to form a closed loop with said sub-capacitor.

3. A voltage indication device according to claim 2, wherein said light emitting indication means is an LED, a tungsten lamp or a plasma discharge tube.

4. A voltage indication device according to claim 1, wherein said light emitting indication means is connected to form a closed loop with said auxiliary winding.

5. A voltage indication device according to claim 4, wherein said light emitting indication means is an LED, a tungusten lamp or a plasma discharge tube.

6. A voltage indication device according to claim 1 wherein said light emitting indication means comprises a series connection of a light emitting indication device and a switching device having an anode, a cathode and a control electrode, said control electrode being supplied with the charged voltage of said sub-capacitor, said series connection being connected between one terminal of said D.C. power supply and the positively charged electrode of said sub-capacitor.

7. A voltage indication device according to claim 6 wherein said light emitting indication device is connected to the cathode of said switching device.

8. A voltage indication device according to claim 6 wherein said light emitting indication device is connected to the anode of said switching device.

9. A voltage indication device according to claim 6 wherein said light emitting indication device is an LED, an incandescent lamp or a plasma discharge tube, and said switching device is a PUT, an SBS, an SCS or an SCR.

10. A voltage indication device according to claim 1 wherein said light emitting indication means comprises a series connection of a light emitting device and a switching device having an anode, a cathode and a control electrode said control electrode being supplied with the voltage generated across said auxiliary winding, said series connection being connected between one terminal of said D.C. power supply and the positively charged electrode of said sub-capacitor.

11. A voltage indication device according to claim 10 wherein said light emitting indication device is connected to the cathode of said switching device.

12. A voltage indication device according to claim 10 wherein said light emitting indication device is connected to the anode of said switching device.

13. A voltage indication device according to claim 10 wherein said light emitting indication device is an LED, an incandescent lamp or a plasma discharge tube, and said switching device is a PUT, an SBS, an SCS or an SCR.

14. In an electronic flashing device having a flashing discharge tube;

a main discharging capacitor for firing said discharge tube by means of energy stored in said discharging capacitor; and a DC-DC converter including a transistor coupled to a D.C. power supply, a transformer having primary, secondary and auxiliary windings coupled to said D.C. power supply and said transistor to form an oscillatory circuit, a sub-capacitor coupled between the auxiliary winding of said transformer and said transistor, a rectifier element interposed between the secondary winding of said transformer and said main discharging capacitor for rectifying the voltage generated across said secondary winding to allow charging of said main discharging capacitor, and a voltage dividing resistor having a tap intermediate the ends thereof connected across the primary winding of said transformer;

a voltage indication device for indicating when the voltage across said discharging capacitor has been charged to a predetermined charged value, comprising a switching device having a control electrode connected to the tap on said voltage dividing resistor, an anode and a cathode, and a light emitting indication device having a definite threshold voltage above which light is emitted connected in series with the anode-cathode circuit of said switching device, said series-connected light emitting indication device and switching device being coupled across the primary winding of said transformer, the tap on said voltage dividing resistor being set to render said switching device conductive when said discharging capacitor has been charged to said predetermined charged value.

15. A voltage indication device according to claim 14 wherein said switching device is a PUT, an SBS, an SCS or an SCR, and said light emitting indication device is an LED, an incandescent lamp or a plasma discharge tube.

16. In an electronic flashing device having a flashing discharge tube;

a main discharging capacitor for firing said discharge tube by means of energy stored in said discharging capacitor; and a DC-DC converter including a transistor coupled to a D.C. power supply, a transformer having primary, secondary and auxiliary windings coupled to said D.C. power supply and said transistor to form an oscillatory circuit, a sub-capacitor coupled between the auxiliary winding of said transformer and said transistor, and a rectifier element interposed between the secondary winding of said transformer and said main discharging capacitor for rectifying the voltage generated across said secondary winding to allow charging of said main discharging capacitor;

a voltage indication device for indicating when the voltage across said discharging capacitor has been charged to a predetermined charged value, comprising a switching device having a control electrode, an anode and a cathode, a light emitting indication device having a definite threshold voltage above which light is emitted connected in series with the anode-cathode circuit of said switching device, said series-connected light emitting indication device and switching device being coupled across said sub-capacitor, and gate voltage applying means connected to said sub-capacitor for applying a gate voltage to the control electrode of said switching device, said auxiliary winding having a number of turns $N_b$ given by the relation $$N_b = \frac{N_2 V_D}{E_2},$$

where $N_2$ designates the number of turns on said secondary winding, $V_D$ said definite threshold voltage and $E_2'$ the predetermined charged voltage of said main discharging capacitor.

17. A voltage indication device according to claim 16 wherein said gate voltage applying means is a voltage dividing resistor for dividing the charged voltage of said sub-capacitor.

18. A voltage indication device according to claim 16 wherein said gate voltage applying means comprises a resistor and a temperature sensitive element connected to said resistor.

19. A voltage indication device according to claim 18 wherein said temperature sensitive element is a resistor having a positive temperature characteristic or a thermistor having a negative temperature characteristic.

20. In an electronic flashing device having a flashing discharge tube;

a main discharging capacitor for firing said discharge tube by means of energy stored in said discharging capacitor; and a DC-DC converter including a transistor coupled to a D.C. power supply, a transformer having primary, secondary and auxiliary windings coupled to said D.C. power supply and said transistor to form an oscillatory circuit, a sub-capacitor coupled between the auxiliary winding of said transformer and said transistor, and a rectifier element interposed between the secondary winding of said transformer and said main discharging capacitor for rectifying the voltage generated across said secondary winding to allow charging of said main discharging capacitor;

a voltage indication device for indicating when the voltage across said discharging capacitor has been charged to a predetermined charged value, comprising a switching device having a control electrode, an anode and a cathode, a light emitting indication device having a definite threshold voltage above which light is emitted connected in series with the anode-cathode circuit of said switching device, said semiconductive light emitting indicator device and switching device being coupled between one terminal of said D.C. power supply and the positively charged electrode of said sub-capacitor, and gate voltage supply means connected across the auxiliary winding of said transformer for applying a gate voltage to the control electrode of said switching device, and auxiliary winding having a number of turns $N_b$ given by the relation $$N_b = \frac{N_2 V_D}{E_2'},$$

where $N_2$ designates the number of turns of said secondary winding, $V_D$ said definite threshold voltage and $E_2'$ the predetermined charged voltage of said main discharging capacitor.

21. A voltage indication device according to claim 20 wherein said gate voltage applying means is a voltage dividing resistor for dividing the voltage generated across said auxiliary winding.

22. A voltage indication device according to claim 20 wherein said switching device is a PUT, an SBS, an SCS or an SCR, and said light emitting device is an LED, an incandescent lamp or a plasma discharge tube.

23. A voltage indication device according to claim 20 wherein said gate voltage applying means comprises a resistor and a temperature sensitive element connected to said resistor.

24. A voltage indication device according to claim 23 wherein said temperature sensitive element is a resistor having a positive temperature characteristic or a thermistor having a negative temperature characteristic.

* * * * *